United States Patent [19]

Vinson

[11] Patent Number: 4,924,826

[45] Date of Patent: May 15, 1990

[54] TEMPERATURE RESPONSIVE ENGINE COMPARTMENT

[76] Inventor: Paul S. Vinson, 3180 Avant Rd., Macon, Ga. 31206

[21] Appl. No.: 343,595

[22] Filed: Apr. 27, 1989

[51] Int. Cl.[5] ..... F02F 7/00; F02B 77/00

[52] U.S. Cl. ..... 123/195 C; 123/198 E; 123/41.05

[58] Field of Search ..... 123/195 C, 198 E, 41.05; 165/41, 51; 181/204; 206/319

[56] References Cited

U.S. PATENT DOCUMENTS

| | | | |
|---|---|---|---|
| 1,833,324 | 11/1931 | Kenneweg | 123/41.05 |
| 2,783,978 | 3/1957 | Baumgarten | 165/44 |
| 3,155,082 | 11/1964 | Roorda et al. | 123/41.05 |
| 3,949,726 | 4/1976 | List | 181/204 |
| 3,951,114 | 4/1976 | Fachbach et al. | 123/195 C |
| 4,057,105 | 11/1977 | Bailey | 165/119 |
| 4,071,009 | 1/1978 | Kraina | 123/198 E |
| 4,114,714 | 9/1978 | Fachbach et al. | 181/204 |
| 4,236,592 | 12/1980 | Ziegler | 180/68 P |
| 4,324,208 | 4/1982 | Danckert et al. | 123/195 C |
| 4,459,944 | 7/1984 | Kirchweger et al. | 123/195 C |
| 4,476,820 | 10/1984 | Nixon | 123/41.05 |
| 4,485,882 | 12/1984 | Ide et al. | 180/68.6 |
| 4,733,750 | 3/1988 | Poirier et al. | 181/204 |

*Primary Examiner*—Charles J. Myhre
*Assistant Examiner*—Weilun Lo
*Attorney, Agent, or Firm*—Thomas & Kennedy

[57] ABSTRACT

An improved motor vehicle engine compartment [10] for protecting the engine from cold by retaining engine heat includes conventional side walls [11,12], hood [13] and cowling [14]. A front wall [16] adjacent the radiator [R] includes a series of movable louvers [22] for covering and uncovering a series of opeings [21]. A lower wall [17] includes a series of movable louvers [24] for covering and uncovering a series of openings [23]. Together these walls and the side walls, hood and cowling form a substantially hermetically sealed enclosure when the louvers are in the covering positions. Actuators [28,29], acting through connecting rods [26,27], move the louvers [22,24] to the covering and uncovering positions. A control circuit [40], responsive to low ambient temperature, high engine temperature and operation of the engine, controls the operation of the actuators [28,29].

5 Claims, 3 Drawing Sheets

Fig 3
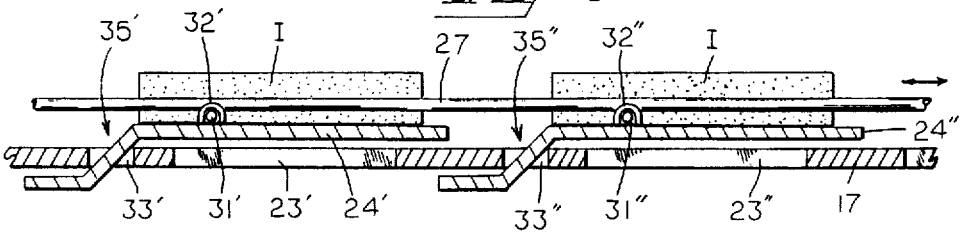
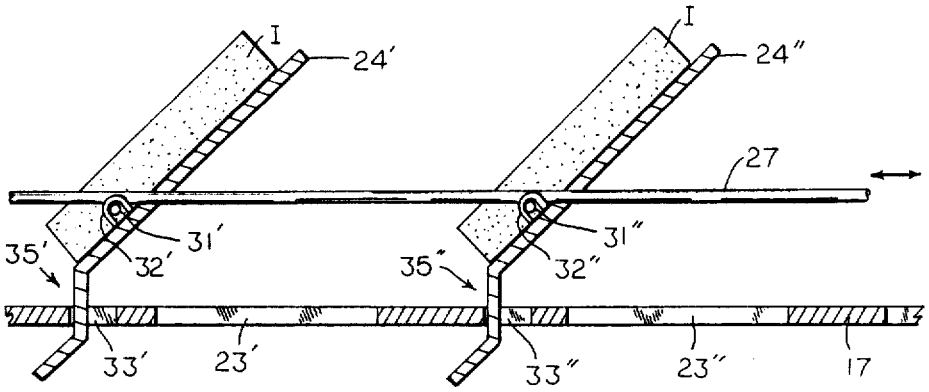
Fig 4
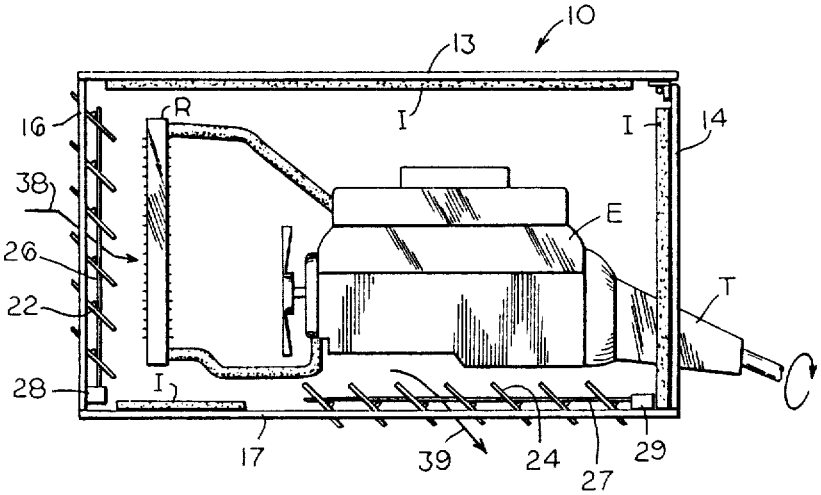
Fig 2

TEMPERATURE RESPONSIVE ENGINE COMPARTMENT

TECHNICAL FIELD

This invention relates generally to motor vehicle engines and, more particularly, to structures that house and shelter such engines.

BACKGROUND OF THE INVENTION

Severely cold weather often is a significant impediment to starting and operating a motor vehicle. For example, such a vehicle left outside in cold weather may experience engine starting difficulties, owing to increased internal friction in the engine, a decrease in performance of the vehicle's electrical system, and increased resistance of the engine's fuel to ignition. In addition, there is always the danger of damage to the engine due to freezing of the coolant, fuel or oil. Also, in a vehicle left outside in cold weather the engine is often slow to warm up to normal operating temperatures, thereby delaying the attainment of a comfortable temperature in the passenger compartment of the vehicle.

Heretofore these cold weather induced problems of hard starting and slow engine warmup have been addressed in a number of ways. Obviously, a heated garage for storing the vehicle overcomes the aforementioned problems. However, a heated garage is something of a rarity and there will be many instances where the vehicle has to be moved to a different location and left unprotected from cold because no garage is available.

Another approach commonly employed has been to supply the engine with heat from an external source to help keep the engine warmer than the ambient temperature. Examples of such are the use of an engine block heater and a simple incandescent lamp placed within the engine compartment. Each of these methods has the notable drawback of requiring access to an external source of electrical power.

Accordingly, it is seen that a need remains for an inexpensive means for protecting a vehicle's engine from cold temperatures, which does not require access to an external source of power, which is carried with the vehicle, and which shortens the period required for the engine to reach normal operating temperature. It is to the provision of such therefore that the present invention is primarily directed.

SUMMARY OF THE INVENTION

In a preferred form of the invention, a motor vehicle engine compartment comprises first, second and other walls which form an enclosure for housing the engine. The first and second walls each have at least one opening formed therein, with first movable closure means for covering and uncovering the opening in the first wall, and second movable closure means for covering and uncovering the opening in the second wall. The enclosure is substantially airtight when the first and second closure means cover the openings. Means are provided which are responsive to low temperature ambient conditions for moving the first and second closure means to positions covering the openings, and which are responsive to operation of the vehicle's engine for moving the first and second closure means to positions uncovering the openings. Thus, in frigid or low temperature conditions, when the engine is turned off, the closure means move to the covering positions, effectively trapping engine heat within the compartment. When the engine is operating the closure means move to their uncovering positions to enable ambient air to flow through the compartment and cool the engine.

In another preferred form, the invention comprises an attachment for use with a conventional automobile engine compartment. The attachment comprises first and second sealing elements adapted to be mounted to the engine compartment. The first and second elements each have an opening and a movable closure means for covering and uncovering the openings. Means are provided responsive to low temperature ambient conditions for moving the closure means to the covering positions, and responsive to operation of the engine for moving the closure means to the uncovering positions.

Other features and advantages of the invention will become apparent upon reading the following specification when taken in conjunction with the accompanying drawings.

BRIEF DESCRIPTION OF THE DRAWINGS

FIG. 2 is a side elevation view of the engine compartment of FIG. 1, with some elements omitted for clarity, with an engine shown mounted therein.

FIG. 3 is a side sectional view of a portion of the engine compartment of FIG. 1 showing openings in one wall of the engine compartment covered by a closure means.

FIG. 4 is a side sectional view of the closure means of FIG. 3 showing the closure means in an uncovering position.

DETAILED DESCRIPTION

Figure 1:
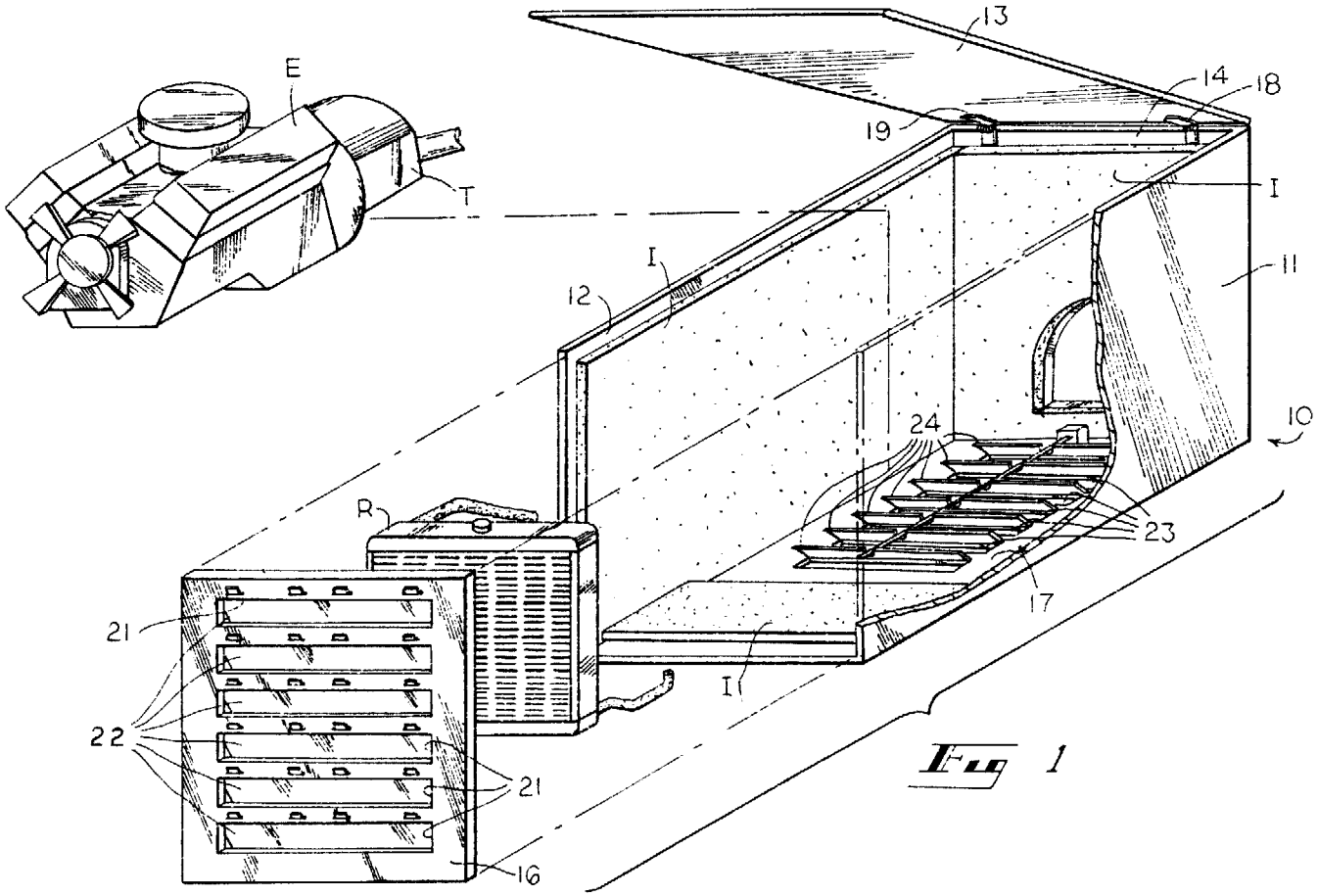
FIG. 1 is an exploded, perspective illustration of an engine compartment according to the present invention.

With reference now in more detail to the drawings, in which like numerals indicate like parts throughout the several views, there is shown in FIGS. 1 and 2 a temperature responsive engine compartment 10 according to a preferred form of the invention. The engine compartment 10 houses an engine E, a portion of a power transmission T, and a radiator R. The compartment has side walls or inner fender panels 11 and 12, rear wall or cowling 14, upper wall or hood 13, front wall 16 and lower wall 17. Hood 13 is hingedly attached to the cowling 14 by means of conventional hood hinges 18 and 19. Each of these walls is clad with a layer of insulation I, some of which is omitted from some figures for clarity.

The front wall 16 has a series of rectangular openings 21,21. These openings are coverable and uncoverable by a series of movable louvers 22. Similarly, the lower wall 17 has a series of openings 23,23 which are coverable and uncoverable by a series of movable louvers 24.

With the hood 13 closed and the louvers 22,24 in their covering positions, a substantially hermetically sealed engine compartment results. In achieving this, the cowling 14 is constructed to have an opening roughly matched to the contour of the power transmission T, as shown in FIG. 1. Various unshown weather seals, of the type previously known, may also be used.

The front louvers 22 are linked to each other by a connecting rod 26, while the lower louvers 24 are linked together by a connecting rod 27. An actuator 28 is mounted to the front wall 16 and coupled to the connecting rod 26. A similar actuator 29 is mounted to the lower wall 17 and coupled to the connecting rod 27.

Figure 5:
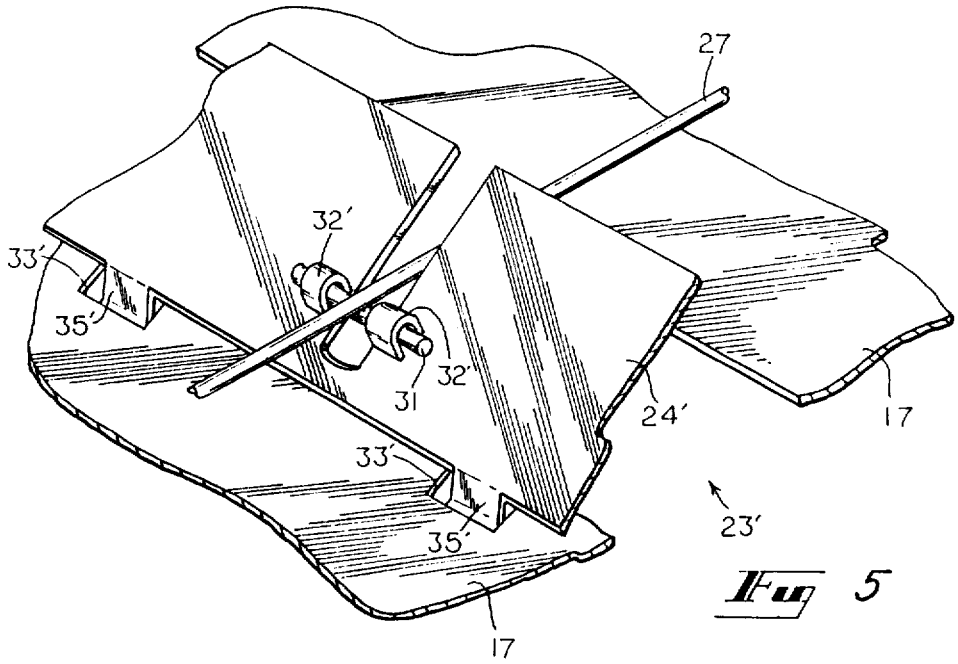
FIG. 5 is a perspective illustration of a portion of the closure means of FIG. 3 with some elements removed for clarity.

As shown in FIGS. 3, 4 and 5, the individual louvers, such as 24' and 24'', are flat panels clad with insulation I, and include offset tabs 35' and 35''. The tabs 35' and 35'' are inserted through small openings 33' and 33'' formed in the lower wall 17 adjacent the openings 23' and 23''. So constructed, the tabs and small openings function as hinges about which the individual louvers may pivot. The connecting rod 27 is rotatably coupled to louvers 24' and 24'' by means of pivot pins 31' and 31''. These pivot pins are fixedly mounted to the connecting rod 27 and are rotatably received within brackets 32' and 32'' mounted on the louvers. The front louvers 22 are similarly constructed. The actuators 28 and 29 pull or push the rods 26 and 27 in response to certain conditions, as will be explained hereinafter, thereby sealing or unsealing the openings 21,21 and 23,23.

Figure 6:
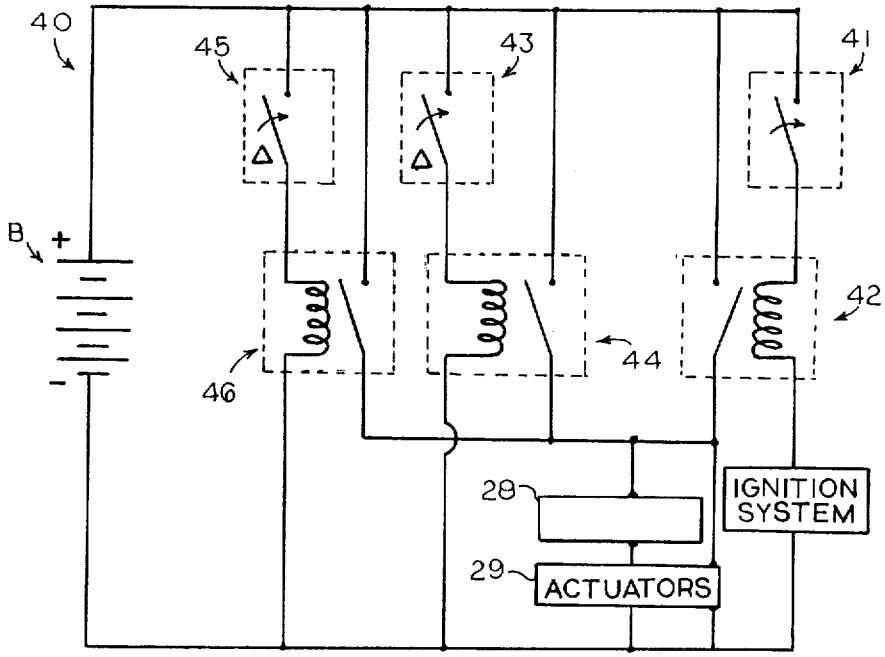
FIG. 6 is a schematic diagram of an electrical circuit for controlling movement of the closure means of FIGS. 1-5.

As shown in FIG. 6, an electric control circuit 40 is provided which is powered by a battery B which may, for example, be the vehicle battery. Current flowing through engine ignition switch 41 causes relay 42 to close, and when current is not flowing through ignition switch 41 relay 42 opens. Excessive engine temperature, such as an engine coolant temperature exceeding 220° F., causes an engine temperature sensitive switch 43 to close, allowing current to pass therethrough, which causes relay 44 to close. Conversely, if the engine temperature switch is open relay 44 is opened. A switch 45 is provided which is sensitive to low temperature ambient conditions and is mounted on the vehicle in a position to be unaffected by engine heat. Should the ambient temperature rise above a selected value, switch 45 closes and causes relay 46 to close. When all three relays 42, 44 and 46 are in the open positions, no current flows through the actuators 28,29 (which are wired in parallel) and the actuators remain in positions which cause the louvers to be in positions covering the openings. Should any of the relays 42, 44 or 46 close, current flows through the actuators which moves the louvers to positions uncovering the wall openings. Thus, the louvers are preferably closed only when the ignition is off, engine temperature is not excessive, and ambient air is cold.

OPERATION

In use, the temperature responsive engine compartment 10 operates as follows. As the vehicle is operated, the engine E generates and transmits excess heat to its surroundings. When the engine is shut off, and when the outside ambient air temperature is sufficiently low, and when the engine temperature is not excessively high, the control circuit 40 causes the actuators 28 and 29 to close the louvers 22 and 24. Low temperature in this context means temperatures close to freezing and below, although, if desired, the apparatus may be made to respond to temperatures 45° F. or below.

With the louvers in the covering positions the heat of the engine is retained within the engine compartment by means of the substantially airtight seal achieved by the engine compartment and by the insulating material I applied to the various surfaces. This heat keeps the engine warm for a prolonged period, making the engine easier to start after the vehicle has been exposed to cold. Such also helps the engine to attain a normal operating temperature more rapidly, upon starting.

Should the engine be switched on, as in starting or during operation, the control circuit 40 causes the actuators to move the louvers to the uncovering positions shown in FIG. 2. Herein, an engine-on condition is meant to include actual engine operation as well as only an ignition switch-on condition. Cooling air and air needed for the combustion process may then be drawn in through the front wall 16 as shown by arrow 38. As the vehicle is operated this cooling air is exhausted as shown by arrow 39. In this regard note that the lower louvers 24 are oriented so that air flow beneath the engine compartment is not directed into the compartment which would create buffeting and bring in road dust. Instead, they are oriented for a smooth flow of air through the compartment about the engine.

Should the ambient air temperature not fall below a selected temperature, e.g. 45° F., the control circuit 40 causes the actuators to maintain the louvers in the uncovering positions. Should the engine temperature exceed a selected value, e.g. 220° F., the control circuit 40 causes the actuators to maintain the louvers in the uncovering positions. While the various walls are illustrated as flat rectangular panels, it is to be understood that as used in motor vehicles these surfaces may take widely different shapes from that shown.

It thus is seen that an improvement to conventional engine compartments is provided which protects the engine from cold by retaining engine heat to allow the engine to be more easily started and more quickly warmed up. It should be understood, however, that the invention has been disclosed in a preferred form only and that many modifications, alterations and additions may be made thereto without departing from the spirit and scope of the invention, as set forth in the following claims.

I claim:

1. In a motor vehicle engine compartment having a plurality of walls forming a compartment housing an engine, the improvement comprising means for retaining engine heat between periods of operation of the engine, said means for retaining engine heat comprising:

a first wall having at least one opening therein and a second wall having at least one opening therein, first movable closure means for covering and uncovering said one opening in said first wall;

second movable closure means for covering and uncovering said one opening in said second wall;

said first and second walls and the remainder of the plurality of walls forming a substantially sealed enclosure when said closure means covers said opening;

means responsive to low temperature ambient conditions for moving said first and second closure means into positions covering said openings and responsive to engine operation for moving said first and second closure means into positions uncovering said openings; and insulating material lining each of said first and second walls;

whereby in low temperature ambient conditions the enclosure is substantially sealed to retain engine heat therewithin from a prior period of engine operation to allow the engine to be more easily restarted and to facilitate engine warm up.

2. The improvement of claim 1 wherein said first closure means and said second closure means each comprise a set of louvers and wherein the engine is associated with a radiator and said first wall is positioned forwardly of the radiator so that the radiator is housed within said substantially sealed enclosure.

3. The improvement of claim 2 further comprising insulating material lining said louvers.

4. The improvement of claim 1 wherein said means responsive to low temperature conditions is further responsive to high engine temperature conditions for moving said first and second closure means to said positions uncovering said openings in response to the detection of a high engine temperature condition.

5. A method of improving the starting characteristics of a vehicle engine housed within an engine compartment in cold conditions comprising the steps of maintaining the engine compartment in a substantially sealed condition when the engine is not operating to retain engine heat generated during a previous period of engine operation and maintaining the engine compartment in an unsealed condition when the engine is operating.

* * * * *